US007527371B2

(12) United States Patent
Yanagi et al.

(10) Patent No.: US 7,527,371 B2
(45) Date of Patent: May 5, 2009

(54) INK JET PRINTING APPARATUS AND METHOD FOR CONTROLLING INK JET PRINTING APPARATUS

(75) Inventors: Haruyuki Yanagi, Machida (JP); Nozomu Nishiberi, Yokohama (JP); Toshiya Matsumoto, Yokohama (JP); Hiroyuki Saito, Yokohama (JP); Kentaro Onuma, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 492 days.

(21) Appl. No.: 11/204,342

(22) Filed: Aug. 16, 2005

(65) Prior Publication Data

US 2006/0038847 A1 Feb. 23, 2006

(30) Foreign Application Priority Data

Aug. 18, 2004 (JP) ..... 2004-238865

(51) Int. Cl.

| | |
|---|---|
| ***B41J 2/01*** | (2006.01) |
| ***B41J 29/38*** | (2006.01) |
| ***B41J 29/393*** | (2006.01) |
| ***B41J 23/00*** | (2006.01) |
| ***B65H 3/06*** | (2006.01) |
| ***B65H 9/16*** | (2006.01) |
| ***B65H 5/02*** | (2006.01) |

(52) U.S. Cl. ..... 347/104; 347/16; 347/19; 347/37; 271/109; 271/250; 271/272

(58) Field of Classification Search ..... 271/109, 271/250, 252, 272; 318/265, 575, 626, 648; 347/5, 8, 16, 19, 37, 39, 104; 400/59, 76, 400/188, 634

See application file for complete search history.

(56) References Cited

U.S. PATENT DOCUMENTS

| | | | | |
|---|---|---|---|---|
| 4,884,909 | A * | 12/1989 | Watanabe et al. | 400/625 |
| 5,506,606 | A | 4/1996 | Saikawa et al. | |
| 6,027,211 | A | 2/2000 | Unosawa et al. | |
| 6,092,892 | A | 7/2000 | Taniguro et al. | |
| 6,582,047 | B2 * | 6/2003 | Koitabashi et al. | 347/16 |
| 6,761,425 | B2 | 7/2004 | Kawaguchi et al. | |
| 6,869,175 | B2 * | 3/2005 | Sinmmachi | 347/104 |
| 6,869,176 | B2 | 3/2005 | Saito | |
| 7,192,207 | B2 * | 3/2007 | Ohashi et al. | 400/188 |

FOREIGN PATENT DOCUMENTS

JP 2002-254736 9/2002

* cited by examiner

*Primary Examiner*—Julian D Huffman
*Assistant Examiner*—Alexander C Witkowski
(74) *Attorney, Agent, or Firm*—Fitzpatrick, Cella, Harper & Scinto

(57) ABSTRACT

An ink jet printing apparatus that can print high quality images under simple control includes a conveying roller disposed upstream of a printing section to convey a print medium, a pinch roller that rotates in cooperation with the conveying roller and discharging rollers that convey the print medium downstream of the printing section. The pinch roller, before a trailing end of the print medium reaches a nip portion between the conveying roller and the pinch roller, moves from a pressure contact position with respect to the conveying roller. A conveyance amount of the print medium varies between before and after separation of the pinch roller from the conveying roller.

2 Claims, 11 Drawing Sheets

INK JET PRINTING APPARATUS AND METHOD FOR CONTROLLING INK JET PRINTING APPARATUS

BACKGROUND OF THE INVENTION

1. Field of the Invention

The present invention relates to an ink jet printing apparatus that performs a printing operation while conveying a print medium to printing means as well as a method for controlling the ink jet printing apparatus.

2. Description of the Related Art

In the prior art, printing apparatuses such as printers are often used to print photographic images. In particular, ink jet printing apparatuses can form images having quality at least equivalent to that of silver photographs owing to a reduction in the size of ink droplets and an improvement in image processing technique. In the ink jet printing apparatus, a print head is kept out of contact with print media conveyed by conveying means and ejects ink droplets. The ink droplets land on the print medium to form an image. Thus, the quality of the image is greatly affected by the accuracy with which the print medium is conveyed. In the ink jet printing apparatus, conveying means is provided upstream and downstream of the print head to convey the print medium; the print head serves as printing means. The upstream conveying means comprises a conveying roller serving as a driving roller that rotates intermittently and a pinch roller provided opposite the conveying roller and serving as a driven roller. A print medium provided by a sheet feeding section is fed downstream by sandwiching it between both rollers and rotating the rollers. Therefore, the upstream conveying means exerts a conveying force until the trailing end of the print medium passes between both rollers.

The print medium fed downstream by the upstream conveying means is printed by the print head and then intermittently conveyed further downward by the downstream conveying means. Then, the print medium is finally discharged to a discharging section.

It is assumed that during the operation of intermittently conveying the print medium, the conveying roller is intermittently stopped immediately before the trailing end of the print medium through a nip formed by the conveying roller and the pinch roller, that is, the conveying roller is stopped with the trailing end of the print medium remaining at the nip. Then, the pinch roller urged against the conveying roller may be rotated by the urging force to push out the print medium downstream from between both rollers. In this case, the print medium is conveyed by a conveying amount larger than a preset conveying pitch. As a result, the image may disadvantageously be uneven.

To eliminate this disadvantage, Japanese Patent Application Laid-Open No. 2002-254736 discloses a technique that controls the conveyance of the trailing end, while suppressing printing deviations by shifting the range of active nozzles in the print head.

This patent document mainly discloses the following:

(1) A sensor senses the position of the trailing end of the print medium so that the trailing end does not remain at the nip portion of the upstream conveying means.

(2) Nozzles located downstream in a print medium conveying direction are not driven so that an image is formed using only the upstream nozzles before the conveyance of the print medium is stopped at the position where the print medium does not remain at the nip position.

(3) The print medium is conveyed to a position downstream of the nip so that the trailing end of the print medium does not remain at the nip portion.

(4) The set of active nozzles is shifted downstream in the print medium conveying direction before an image is formed.

However, the technique disclosed in Japanese Patent Application Laid-open No. 2002-254736 has not solved the problems shown below.

(A) To convey the print medium as described in (1), the conveying amount must be increased above the preset conveying pitch. However, an increase in conveying amount may accumulatively cause a large number of conveying errors in conveying means. This reduces conveying accuracy.

Thus, with the technique disclosed in Japanese Patent Application Laid-open No. 2002-254736, the conveying accuracy must be ensured by increasing the precision of the components of the downstream conveying means, which performs a conveying operation after the print medium has passed through the upstream conveying means. This increases manufacturing costs.

(B) It is necessary to control the amount by which the print medium is conveyed when its trailing end passes through the nip of the upstream conveying means and to shift the range of active nozzles in the print head. This increases printing time compared to that required for normal printing operations. In particular, the increase in printing time is significant if marginless printing is carried out in which an image is printed all over the surface of the print medium without any margins at the ends of the print medium.

SUMMARY OF THE INVENTION

It is an object of the present invention to provide an ink jet printing apparatus which does not require complicated control such as a shift in the range of active nozzles in printing means and a variation in the conveying amount of the print medium, or an increase in the precision of the conveying means, the apparatus being capable of printing high-grade images under simple control, as well as a method for controlling the ink jet printing apparatus.

A first aspect of the present invention is an ink jet printing apparatus in which printing means ejects ink to a print medium for printing, the apparatus comprising: a conveying roller disposed upstream of the printing means to convey the print medium; a pinch roller that rotates in cooperation with the conveying roller; a discharging roller that conveys the print medium downstream of the printing means; moving means for moving the pinch roller from a pressure contact position to a separate position with respect to the conveying roller before a trailing end of the print medium reaches a nip portion between the conveying roller and the pinch roller; and control means for varying the conveyance amount of the print medium between before and after separation of the pinch roller from the conveying roller.

A second aspect of the present invention is a method for controlling an ink jet printing apparatus in which printing means ejects ink to a print medium for printing, the method comprising steps of: conveying the print medium at first conveying amount by the use of the conveying roller disposed upstream of the printing means and the pinch roller under a pressure contact with the conveying roller; separating the pinch roller from a pressure contact position with respect to the conveying roller before a trailing end of the print medium reaches a nip portion between the conveying roller and the pinch roller; and conveying the print medium at second conveying amount, different from the first conveying amount, after separation of the pinch roller from the conveying roller.

The above configuration does not require complicated control such as a shift in the range of nozzles in the print head. High printing quality can be accomplished by simple control in which the driven roller of the conveying means is separated from the driving roller. Therefore, a decrease in throughput can also be suppressed. Further, precise parts need not particularly be used for the conveying means. This allows the apparatus to be inexpensively constructed.

The above and other objects, effects, features, and advantages of the present invention will become more apparent from the following description of embodiments thereof taken in conjunction with the accompanying drawings.

DETAILED DESCRIPTION OF PREFERRED EMBODIMENTS

Figure 1:
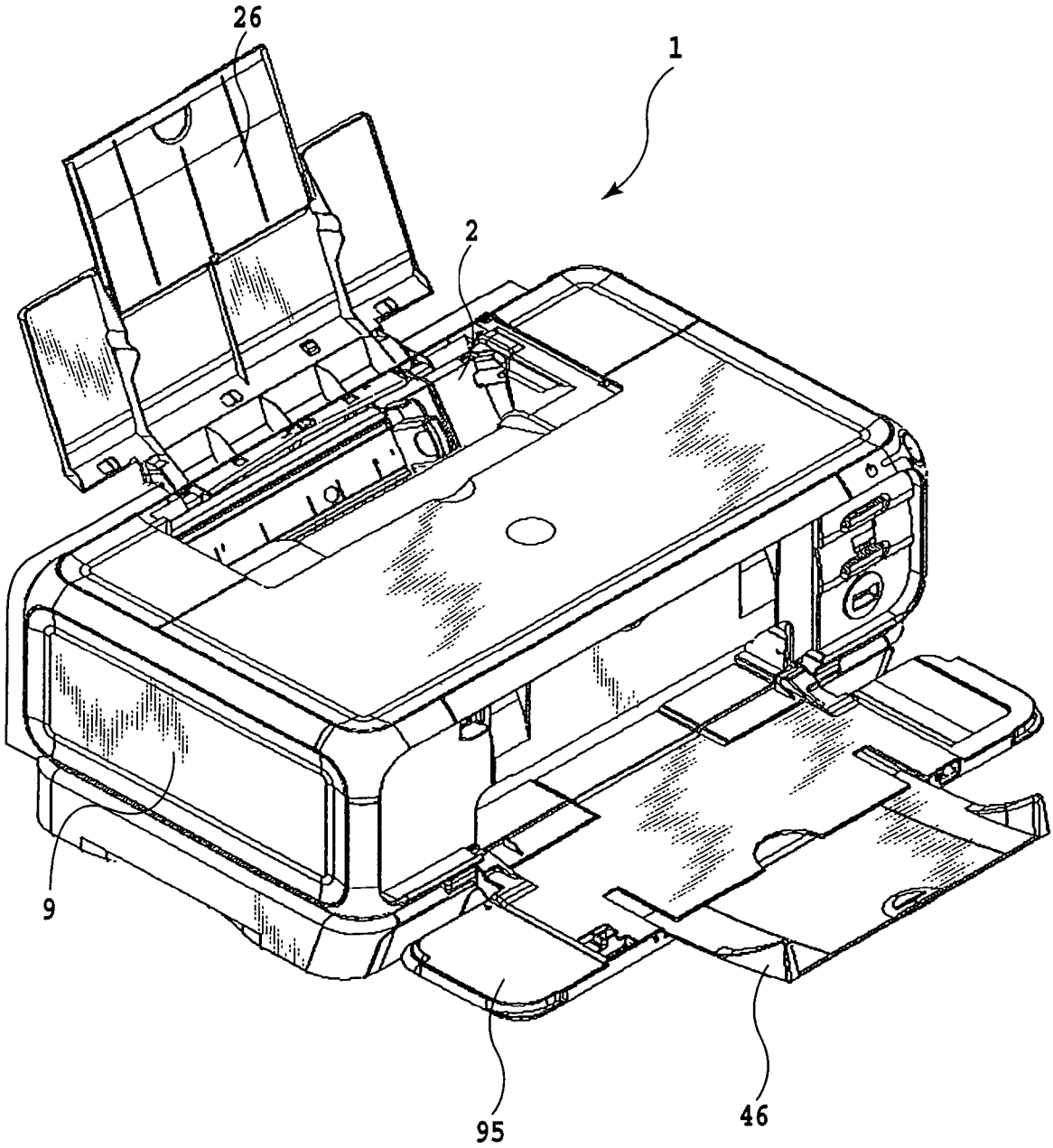
FIG. 1 is a perspective view of a printing apparatus according to an embodiment of the present invention.

With reference to the drawings, description will be given below of the best mode for carrying out the present invention.

First Embodiment

A first embodiment of the present invention will be described with reference to FIGS. 1 to 8B.

A printing apparatus 1 according to the present invention comprises, a sheet feeding section 2, a conveying section 2, a carriage section 5, a discharging section 4, a U turn and automatic double side conveying section 8, and a print head 7. Thus, these components will be sequentially described in brief.

(A) Sheet Feeding Section

Figure 2:
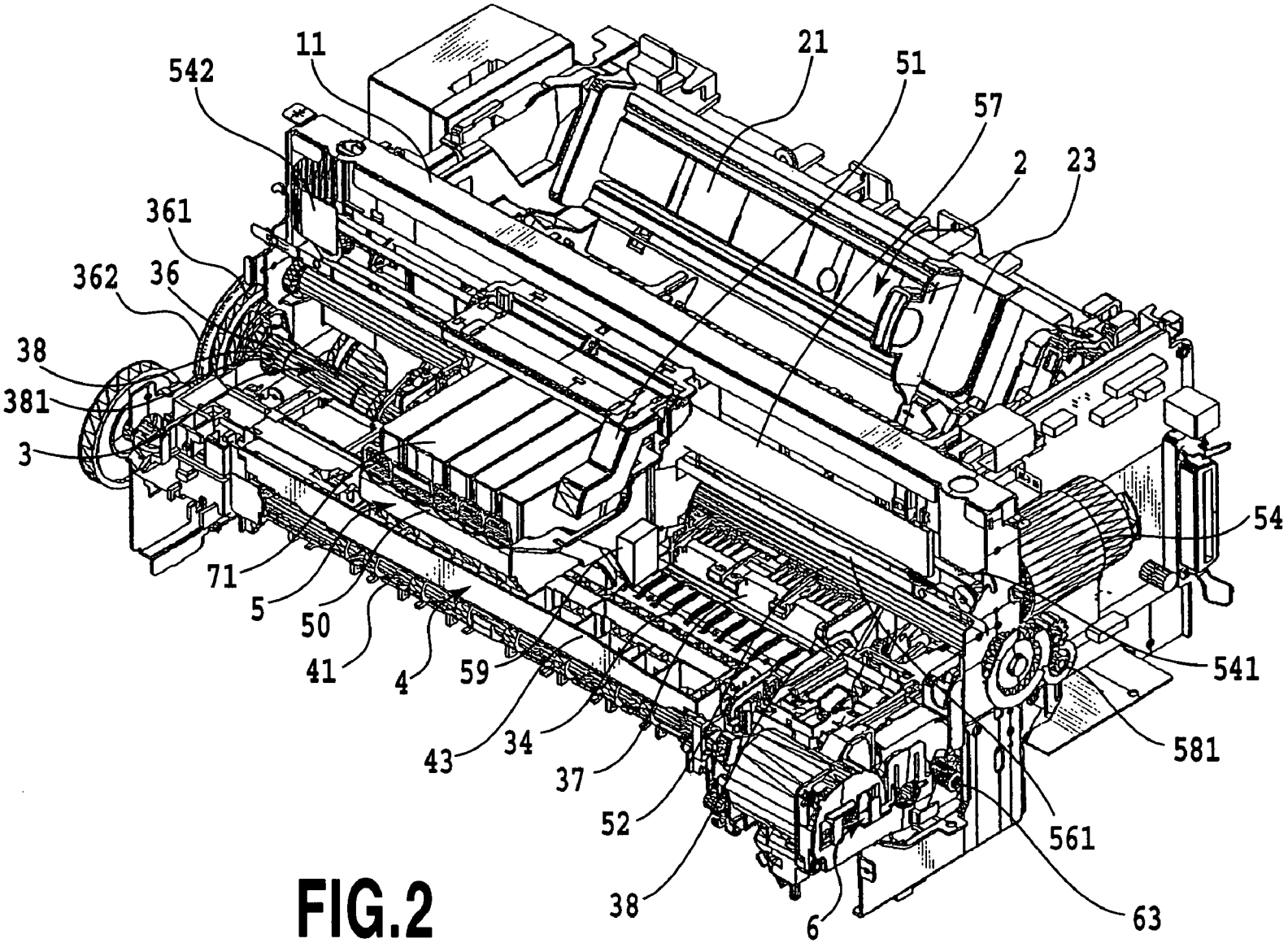
FIG. 2 is a perspective view of a mechanism portion of the printing apparatus according to the embodiment of the present invention.
Figure 3:
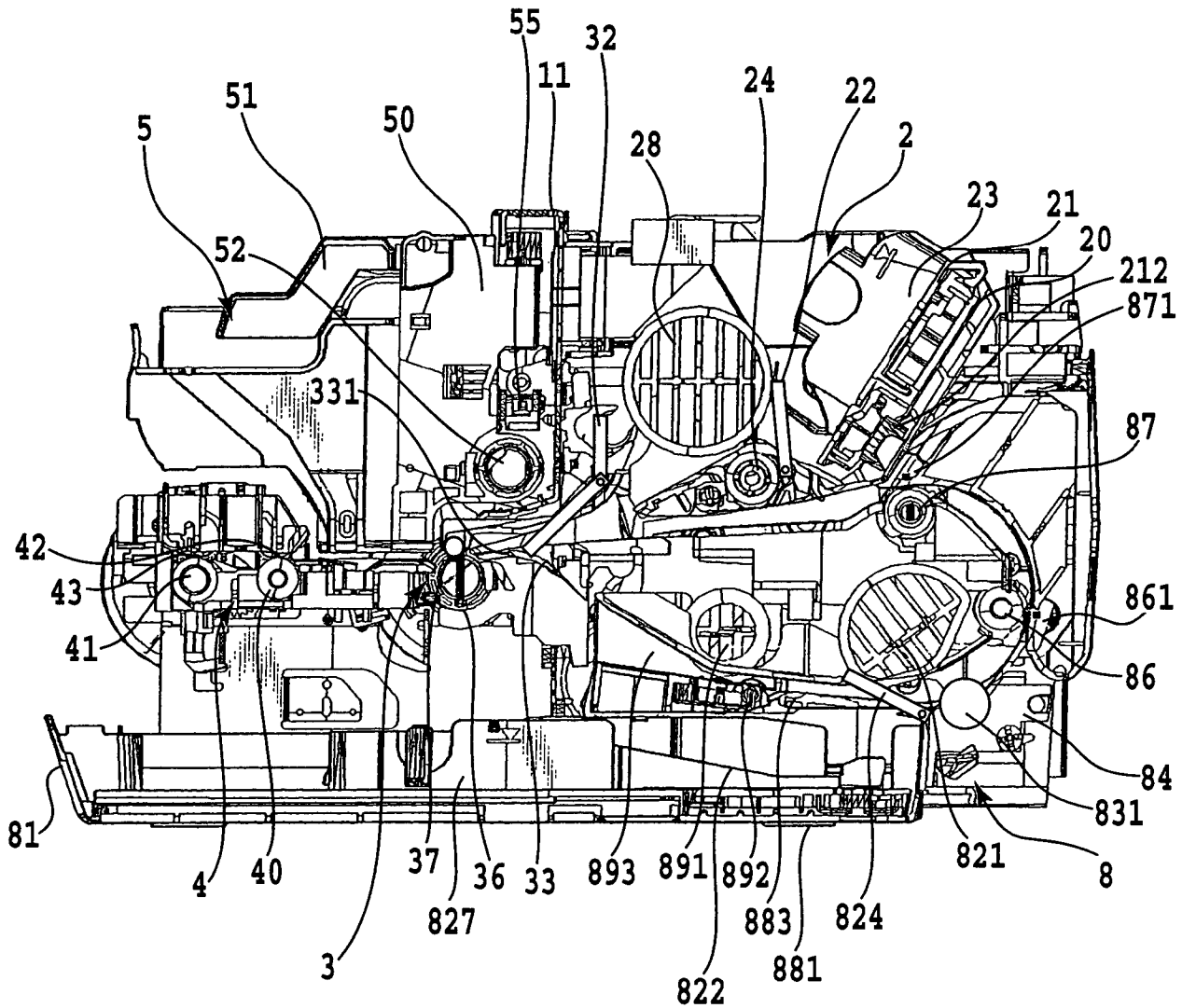
FIG. 3 is a vertical sectional view of the embodiment of the present invention.

In FIGS. 1 to 3, the sheet feeding section 2 is composed of a base 20 to which for example, the following are attached: a pressure plate 21 on which print media P are stacked, a sheet feeding roller 28 that feeds the print media P, a separating roller 24 that separates the print media P from one another, and a return lever 22 that return the print medium P to a stacked position.

A sheet feeding tray 26 is attached to the base 20 or outer sheath to hold the stacked print media P. The sheet feeding tray 26 is operated at multiple steps and pulled out before use.

The sheet feeding roller 28 has a circular cross section. The sheet feeding roller 28 is provided with one piece of sheet feeding roller rubber on a sheet reference side. This allows the print media to be fed. Driving force is transmitted to the sheet feeding roller 28 by a motor shared by a cleaning section (not shown) provided in the sheet feeding section 2.

A movable side guide 23 is movably provided on the platen 21 to regulate the position at which the print media P are stacked. The pressure plate 21 is rotatable around a rotating shaft coupled to the base 20. The pressure plate 21 is urged against the sheet feeding roller 28 by a pressure plate spring 212. A separating sheet (not shown) is provided on the platen 21 and opposite the sheet feeding roller 28 to prevent the print media P located close to the end of the stack from being fed while overlapping; the separating sheet consists of a material such as artificial leather which has a large coefficient of friction. The platen 21 is configured so that it can abut against and separate from the sheet feeding roller 28.

Moreover, a separating roller 24 is attached to a separating roller holder (not shown) to separate the print media P from one another. The separating roller 24 is provided on the base 20. The separating roller 24 is urged against the sheet feeding roller 28 by a spring or the like. A clutch spring is attached to the separating roller 24. When at least a predetermined load is imposed on the separating roller 24, the part to which the separating roller 24 is attached can be rotated. The separating roller 24 is configured so that it can abut against and separate from the sheet feeding roller 28. The positions of the pressure plate 21, return lever 22 and separating roller 24 are detected by ASF (Auto Sheet Feeder) sensor.

Further, the return lever 22 used to return the print media P to the stacked position is rotatably attached to the base 20 and urged by a return lever spring in a releasing direction. The return lever 22 is configured to be rotated by a control cam (not shown) in order to return the print media P.

In a normal standby state, the platen 28 is released, and the separating roller 24 is released from the sheet feeding roller 28 by the control cam. Further, the return lever 22 is provided at the stacked position such that it can return the print media P to close a stack port so as to prevent the print media P from being moved inward during stacking. In this state, when sheet feeding is started, the motor performs driving to abut the separating roller 24 against the sheet feeding roller 28. Then, the return lever 22 is released to abut the platen 21 against the sheet feeding roller 28. In this state, feeding of the print media P is started. The print media P are restricted by a front separating section provided on the base 20. Thus, only a predetermined number of print media P are fed to a nip portion formed by the sheet feeding roller 28 and separating roller 24. The fed print media P are separated from one another at the nip portion with only the uppermost print medium P conveyed.

When the print medium P reaches a conveying roller 36 and a pinch roller 37 described below, the pressure plate 21 and the separating roller 28 are released by a pressure plate cam and a control cam, respectively. The return lever 22 is returned to the stacked position by the control cam. At this time, the print medium having reached the nip portion can be returned to the stacked position, the nip portion being formed by the sheet feeding roller 28 and the separating controller 24.

(B) Conveying Section

The conveying section 3 is attached to a chassis 11 consisting of sheet metal that is bent upward. The conveying section 3 has a conveying roller 36 that conveys the print medium P and a PE sensor 213. The conveying roller 36 is composed of a metal shaft coated with fine grains of ceramics. The metal shaft is attached to the chassis with its metal portion supported by a bearing 38. A conveying roller tension spring 381 is provided between the bearing 38 and the conveying roller 36. The conveying roller 36 is urged in a thrust direction to prevent misalignment of the conveying roller 36 in the thrust direction.

The conveying roller 36 is provided with a plurality of driven pinch rollers 37 that abut against the conveying roller 36. The pinch rollers 37 are held by a pinch roller holder 30 shown in FIG. 4. The urging force of a pinch roller spring 31 shown in FIG. 4 presses the pinch rollers 37 into contact with conveying roller 36 to exert a conveying force on the print medium P. In this case, a rotational-movement fulcrum shaft 30*a* of the pinch holder 30 is attached to a bearing of the chassis 11. The pinch roller holder 30 rotates around the rotational-movement fulcrum shaft 30*a*. Moreover, a paper guide flapper a33 and a platen 34 are disposed at an inlet of the conveying section 3, to which the print medium P is conveyed; the paper guide flapper a33 and platen 34 guide the print medium P. Further, a PE sensor lever 32 is provided on the pinch roller holder 30 to inform the PE sensor 213 that the leading end or trailing end of the sheet P has passed through the pinch roller 37. The platen 34 is attached to and positioned on the chassis 11. The paper guide flapper 33 is rotatable around a bearing portion 331. The paper guide flapper 33 is positioned by abutting against the chassis 11. Further, the paper guide flapper fits the conveying roller 36.

In the above configuration, the print medium P fed to the conveying section 3 is guided to the pinch roller holder 30 and paper guide flapper 33. The print medium P is then fed to the pair of the conveying roller 36 and pinch roller 37. At this time, the PE sensor 213 senses the leading end of the print medium P conveyed to the PE sensor lever 32. A print position on the print medium P is determined on the basis of a detection signal from the PE sensor 21. Further, the paired rollers 36 and 37 are rotated by a conveying motor (not shown) to convey the print medium P on the platen 34. Ribs serving as a conveying reference surface are formed on the platen 34. The ribs can be used to manage the distance between the print head 7 and the print medium and to control waving of the print medium together with a discharging section described below.

The conveying roller 37 is driven by transmitting the rotating force of a conveying motor 35 consisting of a DC motor to a pulley 361 provided on a shaft of the conveying roller 36 via a timing belt or the like. Further, a code wheel 362 is provided on the shaft of the conveying roller 36; on the code wheel 362, markings are formed at a pitch of 150 to 300 lpi in order to detect the amount by which the print medium has been conveyed by the conveying roller. Moreover, an encoder sensor 363 is attached to the chassis 11 adjacent to the code wheel 362 to read the markings on the code wheel 362.

A print head 7 is provided downstream of the conveying roller 36 in the direction in which the print medium is conveyed; the print head 7 forms an image on the basis of image information. An ink jet print head is use as the print head 7; replaceable ink tanks 71 for the respective colors are mounted on the print head. The print head 7 can heat ink using a heater or the like. The heat makes the ink generate film boiling to grow or contract air bubbles to vary pressure. This causes the ink to be ejected from nozzles in the print head 7 to form an image on the print medium P.

(C) Carriage Section

The carriage section 5 has a carriage 50 to which the print head 7 (see FIGS. 5A to 5D) is attached. The carriage 50 is supported by a guide shaft 52 used to reciprocatively scan the print medium P in the direction crossing the conveying direction, and a guide rail 111 that holds the trailing end of the carriage 50 to maintain a clearance between the print head 7 and the print medium P. The guide shaft 52 is attached to the chassis 11. The guide rail 111 is integrated with the chassis 11.

Further, the carriage 50 is driven via a timing belt 541 by a carriage motor 54 attached to the chassis 11. The timing belt 541 is extended and supported by an idle pulley 542. The timing belt 541 is coupled to the carriage 50 via a damper consisting of rubber or the like. The damper 55 attenuates vibration of the carriage motor 54 and the like to reduce the unevenness of images. A code strip 561 with markings formed at a pitch of 150 to 300 lpi (line per inch) is provided parallel to the timing belt 541 to detect the position of carriage 50. Moreover, an encoder sensor that reads the markings is provided on a carriage substrate mounted on the carriage 50. The carriage substrate is provided with a contact for an electric connection with the print head 7. The carriage 50 also comprises a flexible substrate 57 used to transmit a head signal from an electric substrate 9 to the print head 7.

To fix the print head 7 to the carriage 50, the carriage 50 is provided with positioning means and pressing means. The pressing means is mounted on a head set lever 51. The pressing means acts on the print head 7 when the head set lever 51 is set by rotating it around a rotating fulcrum.

Further, eccentric cams are provided at the opposite ends of the guide shaft 52. The guide shaft 52 can be raised and lowered by transmitting the driving force of a main cam of the cleaning section 6, which cleans the print head, to the eccentric cam via a gear train 581. Raising or lowering the guide shaft 52 enables the carriage 50 to be raised or lowered. This makes it possible to set the distance between the print head and the print medium P in the optimum condition even if the print medium P has a varying thickness. The driving force for the main cam 63 is transmitted by the motor shared by the cleaning section.

Moreover, the carriage 50 is provided with a registration adjustment sensor 59 which automatically correct the deviation of a landing position of ink ejected from the print head 7 onto the print medium P. The registration adjustment sensor 59 is a reflective optical sensor. A light emitting sensor of the registration adjustment sensor 59 emits light. Light reflected by a predetermined print pattern on the print medium P is then received. Thus, the optimum registration adjustment value can be determined.

In the above configuration, when an image is formed on the print medium P, the paired rollers 36 and 37 convey the print medium P to a raster position at which the image is formed (position in the direction in which the print media P are conveyed). Further, the carriage motor 54 is used to convey the print medium P to a column position at which the image is formed (position perpendicular to the conveying direction of the print medium) so that the print head 7 lies opposite the image formed position. Subsequently, as previously described, a signal from the electric substrate 9 causes the print head 7 to eject ink to the print medium P to form the image.

(D) Discharging Section

The discharging section 4 is composed of for example, two discharging rollers 40 and 41, spurs 42 and 43 that abut against the discharging rollers 40 and 41 at a predetermined pressure to rotate in union with the discharging rollers 40 and 41, and a gear train used to transmit driving force from the conveying roller to discharging rollers 40 and 41.

The discharging rollers 40 and 41 are attached to the platen 34. The discharging roller 41, located downstream in the print media conveying direction, has a plurality of rubber portions provided on the metal shaft. The sheet driving shafts 40 and 41 are driven by transmitting a driving force from the conveying roller 36 to the downstream discharging roller 41 via an idler gear. The upstream discharging roller 40 is composed of a resin shaft to which a plurality of elastomers are attached. The upstream discharging roller 40 is driven by transmitting a driving force from the downstream discharging roller 41 via an idler gear.

The spurs 42 and 43 are thin stainless steel plates. The spurs 42 and 43 are made by providing a plurality of convex portions on the thin plate and then molding the thin plate integrally with a resin portion. A spur spring that is a bar-like coil spring is used to attach the spurs 42 and 43 to a spur holder and to press the spurs 42 and 43 against the discharging rollers 40 and 41 and the like. The spurs are provided on the elastomer portion of the discharging roller 40 and at positions corresponding to the rubber portion of the discharging roller 41. The spurs include those that exert a conveying force on the print medium P and those provided at positions where the elastomer portion and rubber portion of the discharging rollers 40 and 41 are absent. The latter spurs mainly serve to suppress floating of the print medium P during printing.

A paper end support is disposed ahead of the discharging roller 41 to raise the opposite ends of the print medium P so that the print medium P is held ahead of the discharging roller 41. The paper end support prevents a printed portion of a previously discharged print medium P from being contacted with a subsequently discharged print medium P. This in turn prevents possible damage to the image on the previously discharged print medium. The paper end support is composed of a resin member having a roller at its leading end and urged by a support spring. The roller of the paper end support presses the print medium P at a predetermined pressure to raise the opposite ends of the print medium P. This causes the subsequently discharged print medium to be flexibly bent. Consequently, the subsequently discharged print medium is held above the previously discharged print medium P.

With the above configuration, an image is formed on the print medium P by the carriage section 5. The print medium P is then conveyed while being caught in the nip between the discharging rollers and the spurs. The print medium P is then discharged to a sheet discharging tray 46. The sheet discharging tray 46 can be housed in a front cover 95 and can be pulled out before use. Both the leading end of the sheet discharging tray 46 are configured to extend upward. This allows the discharged print media P to be stacked more appropriately and prevents printed surfaces from being rubbed against one another.

(E) U Turn and Automatic Double Side Section

The print media P are housed in a cassette 81 provided in front of the apparatus. To separate and feed the print media P, a pressure plate 822 is provided on which the print media P are stacked. The pressure plate 822 is provided in the cassette 82 so as to abut the stacked print media against a sheet feeding roller 821. Further, for example, the following are attached to a UT base of the main body: a sheet feeding roller 821 that feeds the print media P, a separating roller 831 that separates the print media P from one another, a return lever 824 that returns the print media P to the stacked position, and means for controllably pressing the print media P against the pressure plate 822.

The cassette 81 can be contracted at two steps according to the size of the print medium P. For small-sized paper or when the cassette is not used, the cassette 81 can be contracted. The cassette 1 can be housed inside the outer covering 9 of the main body.

The sheet feeding roller 821 has a circular cross section. The sheet feeding roller 821 is provided with one pierce of sheet feeding roller rubber on the sheet reference side to feed the print media. A driving force by a U turn and automatic double side motor (not shown) is transmitted to the sheet feeding roller 821, the motor being provided in the U turn and automatic double side section 5.

The platen 822 is movably provided with a movable side guide 826 to regulate the print media stacked position. The pressure plate 822 is rotatable around a rotating shaft coupled to the cassette 81. The pressure plate 822 is urged against the sheet feeding roller 821 by the press and control means, provided on the UT base 84 and consisting of a pressure plate spring 828. A separating sheet (not shown) is provided on the platen 822 opposite the sheet feeding roller 821 to prevent the print media P from being fed while overlapping when the number of print media stacked decreases. The separating sheet consists of a material such as artificial leather which has a large coefficient of friction. The pressure plate 822 is configured so that it can abut against and separate from the sheet feeding roller 821.

Moreover, a separating roller (not shown) is attached to a separating roller holder (not shown) to separate the print media P from one another. The separating roller is urged against the sheet feeding roller 821. A clutch spring is attached to the separating roller. When at least a predetermined load is imposed on the separating roller, the part to which the separating roller is attached can be rotated. The separating roller is configured so that it can abut against and separate from the sheet feeding roller 821. A UT sensor senses the positions of the platen 822, return lever 824, and separating roller.

The return lever 824, used to return the print media P to the stacked position, is rotatably attached to the UT base 83 and urged in a releasing direction by a lever spring. To return the print media P, the return lever 824 is rotated by a control cam.

In a normal standby state, the pressure plate 822 is released, and the separating roller 831 is also released. The return lever 824 is provided at the stacked position such that it can return the print media P to close a stack port so as to prevent the print media P from being moved inward during stacking. To start feeding sheets in this state has the separating roller 831 abut the sheet feeding roller 821 by the driving force of the motor. The return lever 824 is released to abut the pressure plate 822 against the sheet feeding roller 821. In this state, feeding of the print media P is started. The print media P are restricted by a front separating section provided on the UT base 84. Thus, only a predetermined number of print media P are fed to a nip portion formed by the sheet feeding roller 821 and separating roller 831. The fed print media P are separated from one another at the nip portion with only the uppermost print medium P conveyed.

Two conveying rollers, a first U turn intermediate roller 86 and a second U turn intermediate roller 87, are provided downstream of the sheet feeding part in order to covey the fed print medium. These rollers are each composed of a core bar of a metal shaft to which EPDM of rubber hardness 40 to 80° is attached at four to six positions. U turn pinch rollers 861 and 871 are attached to a spring shaft at positions corresponding to the rubber portions in order to sandwich the print medium P between the rollers. The U turn pinch rollers 861 and 871 are urged against the first and second U turn intermediate rollers 86 and 87. Further, an inner guide 881 and an outer guide (not shown) are constructed in order to form a conveying path; the inner guide 881 forms an inner side, while the outer guide forms an outer side.

When the separated and conveyed print medium P reaches the first U turn intermediate roller 86 and U turn pinch roller 861, the platen 822 and the separating roller 831 are released by the control cam. The return lever 824 is returned to the stacked position by the control cam. At this time, the print medium P having reached the nip portion can be returned to the stacked portion, the nip portion being formed by the sheet feeding roller 821 and the separating roller 831.

The junction between the sheet feeding section 2 and the conveying path is composed of a flapper 883 so that the paths can be joined smoothly. When fed to the conveying roller 36 and pinch roller 37, the leading end of the print medium P is abutted against the nip between the stopped rollers. This enables de-skewing.

The trailing end of the print medium P on which the image has been formed by the carriage section 5 slips between the conveying roller 36 and the pinch roller 37. For automatic double side printing, the trailing end of the print medium P the first side of which has been printed is conveyed in the opposite direction and thus fed to the conveying roller 36 and pinch roller 37 again. The print medium is then conveyed while being sandwiched between both rollers 36 and 37. On this occasion, the print medium P is fed to the conveying roller 36 and pinch roller 37 while the pinch roller 37 is being raised by a raising and lowering mechanism. This allows the print medium P to be conveyed smoothly between both rollers 36 and 37.

The print medium P fed to between both rollers 36 and 37 again is conveyed while being sandwiched between a double side roller 891 and a pinch roller 892. The print medium P is then conveyed being guided by a guide member 893. The double side conveying path joins to the U turn conveying path at a predetermined position. Therefore, the succeeding configuration of the conveying path for the print medium and the subsequent operations are the same as those described above.

(E) Summary of Configuration of Control System

Figure 6:
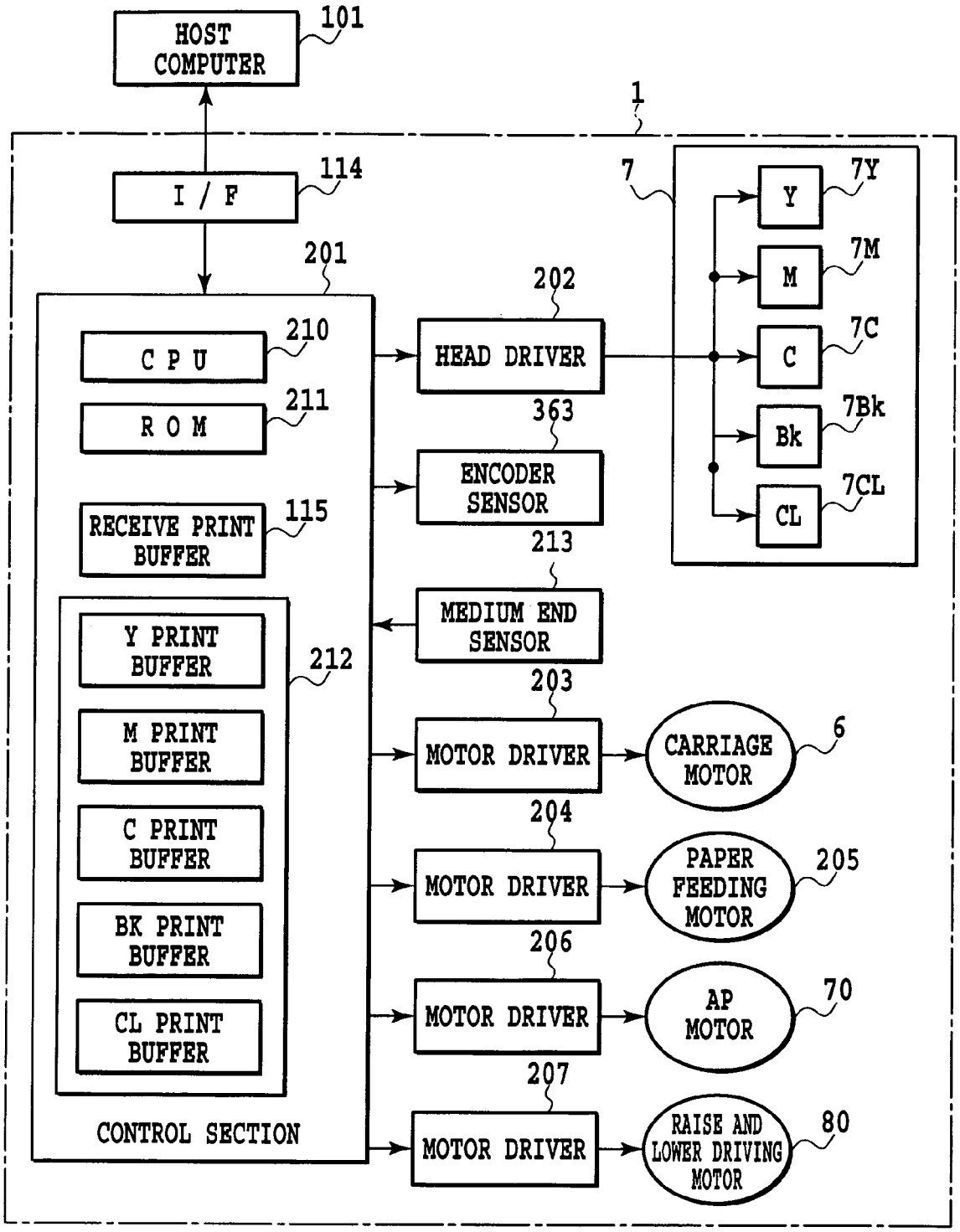
FIG. 6 is a block diagram schematically showing a control system according to the embodiment of the present invention.

FIG. 6 is a block diagram showing the configuration of an essential part of the control system according to the embodiment of the present invention.

In FIG. 6, reference numeral 101 denotes a host computer connected to the printing apparatus via an interface 114. A print driver has been input to and housed in the host computer 101; the printer driver generates image and control information used to allow the printing apparatus 1 to perform a printing operation. Image information is generated by the printer driver and hardware resources in a host computer.

On the other hand, reference numeral 201 denotes a control section serving as control means for generally controlling the operation of the printing apparatus 1. The control section has, for example, a CPU 210 such as a microprocessor, a ROM 211 that stores control programs executed by the CPU 210 as well as various data, and a RAM 212 used as a work area when the CPU 210 executes various processes, to temporarily hold various data. The RAM 212 is provided with a receive buffer 115 and print buffers (image information storage means) for Y, M, C, Bk, and CL which stores print data supplied in association with print heads 7Y, 7M, 7C, 7Bk, and 7CL that carry out printing using inks in respective colors Y, M, C, Bk, and CL. In the specification, these print heads may be collectively referred to as the print head 7.

Reference numeral 202 denotes a head driver that drives a yellow print head 45Y, a magenta print head 45M, a cyan print head 45C, a black print head 45Bk, and a light cyan print head 45CL according to print data for the respective colors output by the control section 201. Reference numerals 203, 204, 206, and 207 denote motor drivers that drive the corresponding carriage motor 6, a sheet feeding motor 205, an AP motor 70, and a raise and lower driving motor that rotates a pinch roller release gear 303 described below.

Further, a PE sensor is provided at a predetermined reference position in a conveying path to the print head from the junction between a conveying path (first conveying path) from the sheet feeding section of the ink jet printing apparatus and a conveying path (second conveying path) from the cassette. The PE sensor 213 has its output switched off when the end of the print medium conveyed from the first or second path reaches the reference position. On the basis of the output, the CPU 210 determines whether or not the end of the print medium has reached the reference position.

Further, a pulse signal from an encoder sensor 363 is input to the CPU 210 to enable the CPU 210 to detect the moving position of the carriage.

(G) Conveying Control of Print Medium Trailing End During Printing Operation

Now, description will be given of a conveying operation performed when the trailing end of the print medium is printed according to a first embodiment of the present invention.

Upon receipt of a printing start instruction, the print medium P is fed from the sheet feeding section 2 or cassette 81 as previously described. The fed print medium P is conveyed by the conveying roller 36 by a predetermined amount. The print head 7 mounted on the carriage 50 carries out predetermined printing. If marginless printing is carried out, ink flying outside the end of the print medium P lands and is absorbed by a platen absorber 344 provided on the platen 34. That is, the platen absorber 344 absorbs all the ink landing outside the four ends of the print medium P.

Figure 7:
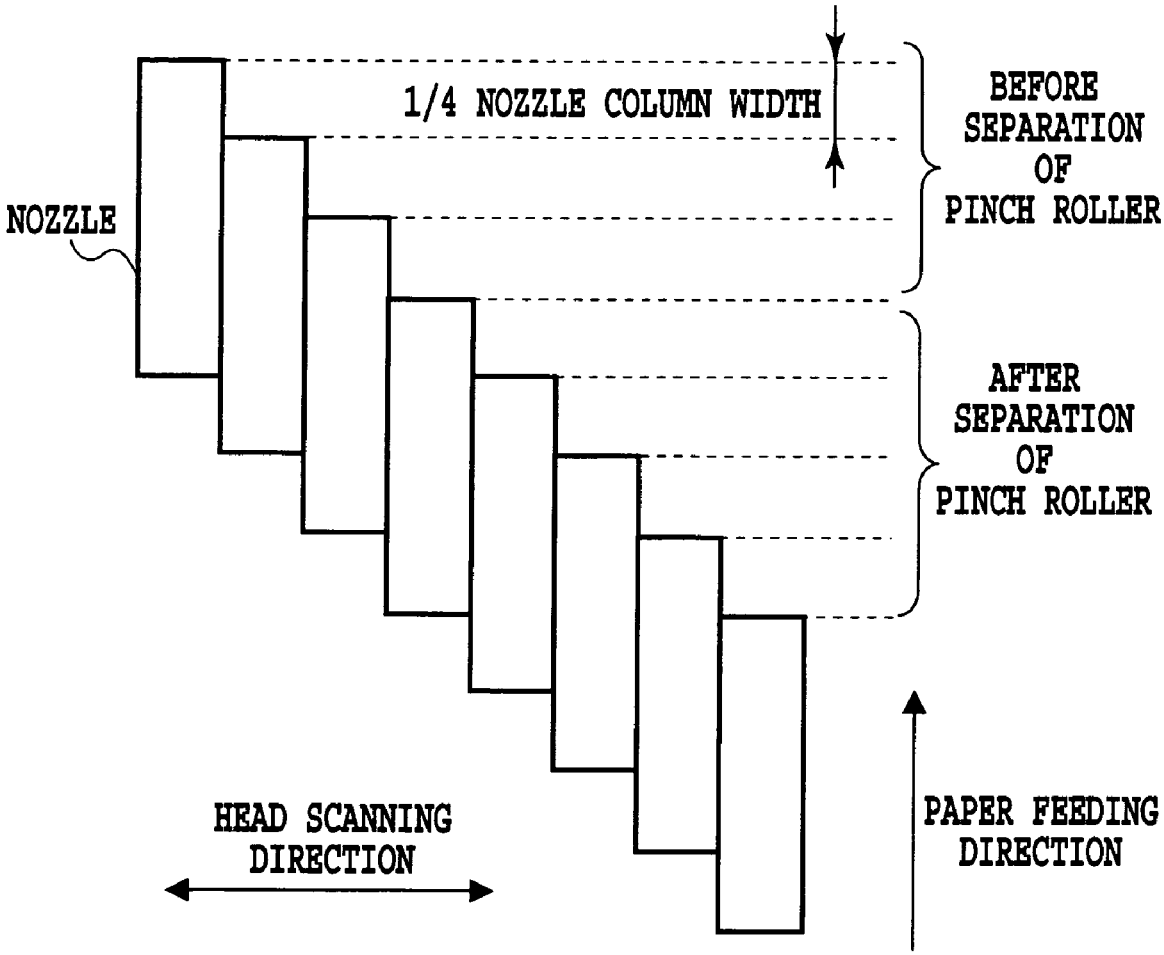
FIG. 7 is a diagram illustrating an operation of conveying the print medium as well as multi-pass printing with four passes according to a first embodiment of the present invention.

FIG. 7 is a diagram illustrating an operation of conveying the print medium P and the state of multi-pass printing.

As shown in the figure, in the first embodiment, four-pass printing is carried out in which an image of each raster to be formed is completed by scanning the print head over the raster four times. Further, the center of the pinch roller 37 is slightly offset from the center of the conveying roller 36 in the direction where print medium P is conveyed, so that the nip between the conveying rollers 36 and the pinch roller 37 faces slightly downward. Thus, the print medium P fed to between the conveying roller 36 and the pinch roller 37 is fed out to the platen 34. Thus, the print medium can always be conveyed in contact with the platen 34 even if the print medium is thin like ordinary paper. This makes it possible to prevent the print medium from being flexed or floating on the platen. Consequently, the contact between the print head 7 and the print medium is avoided, whereas the spacing between the print head and the print medium is maintained at a fixed value.

As the printing operation proceeds, the trailing end of the print medium P passes through the position where it is detected by the PE sensor 213. Then, the PE sensor 213 outputs a trailing end detection signal. The CPU receives the trailing end detection signal to recognize the position of the trailing end of the print medium (see FIG. 5A). Upon receipt of the trailing end detection signal, the CPU causes the print medium P to be conveyed by a predetermined amount. When the trailing end of the print medium P nears the nip between the conveying roller 36 and the pinch roller 37, the conveying motor is stopped to halt the conveying operation performed by the conveying roller 36 and the pinch roller 37 (see FIG. 5B). In this case, the trailing end of the print medium has passed by the print head 7 and is caught in the nip between the sheet feeding rollers 40 and 41 and the spurs 42 and 43.

Figure 5A:
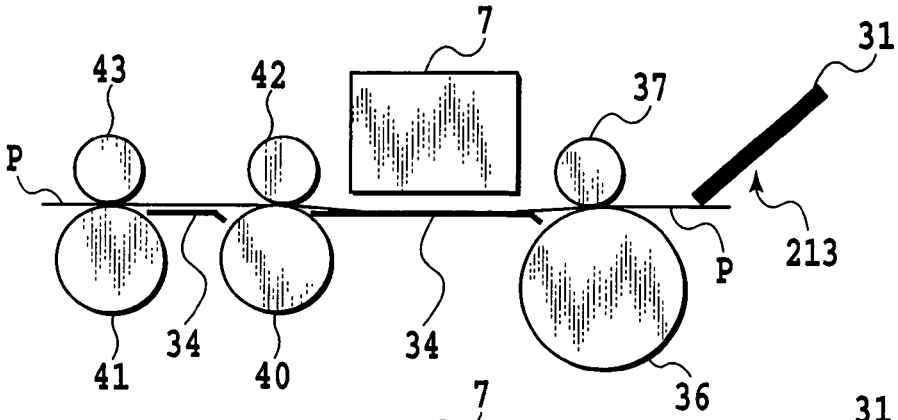
FIGS. 5A to 5D are diagrams showing how a printing operation is performed on a trailing end of a print medium according to the embodiment of the present invention.
Figure 5B:
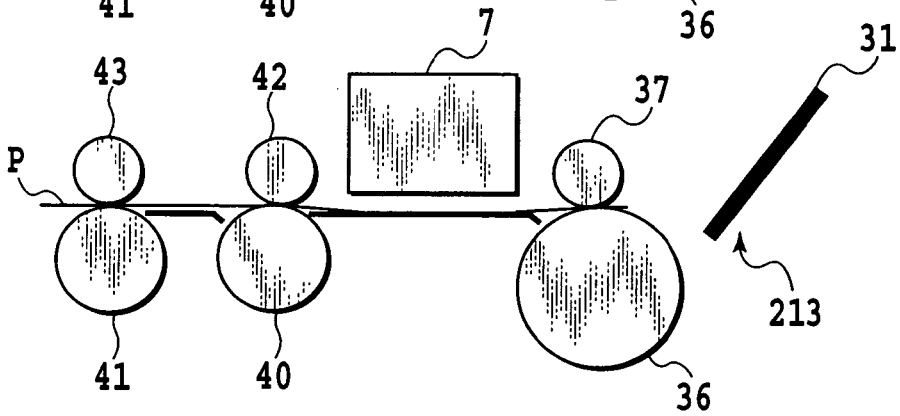
Figure 5C:
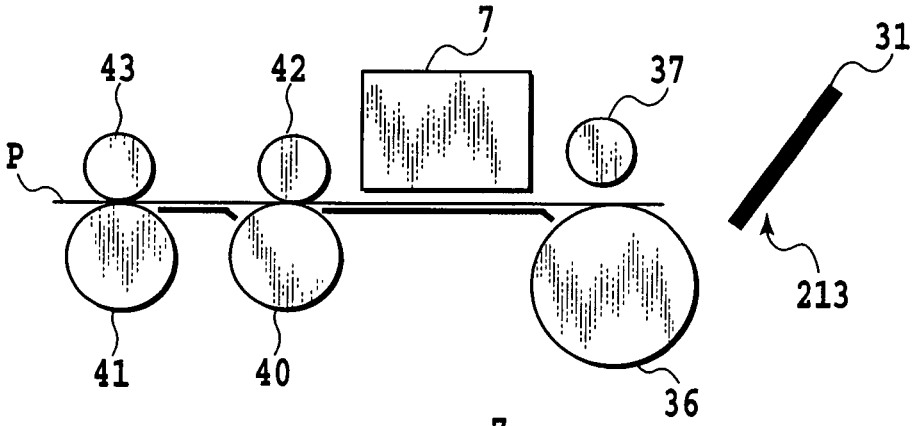
Figure 5D:
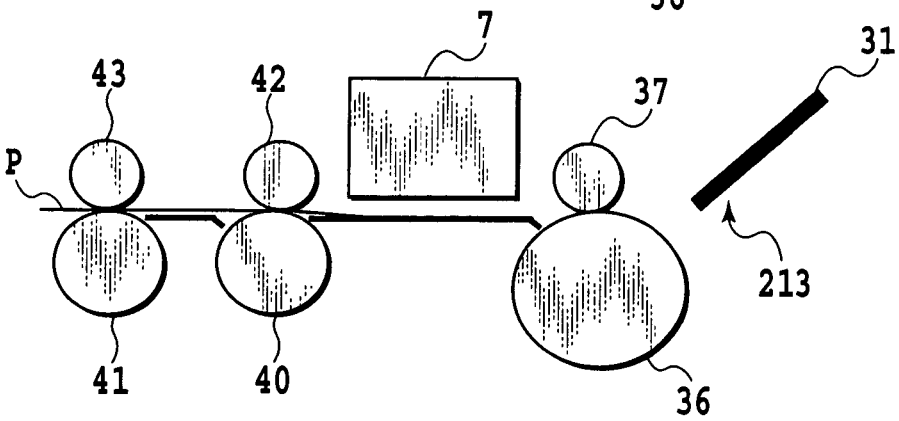

In the state shown in FIG. 5B, after the operation of conveying the print medium P is stopped, the CPU 210 separates the pinch roller 37 from the print medium P and conveying roller 36 by a predetermined amount (see FIG. 5D). This operation is performed by the CPU 210 by controlling the raise and lower driving motor 80, a driving source for the pinch roller raising and lowering mechanism.

Figure 4:
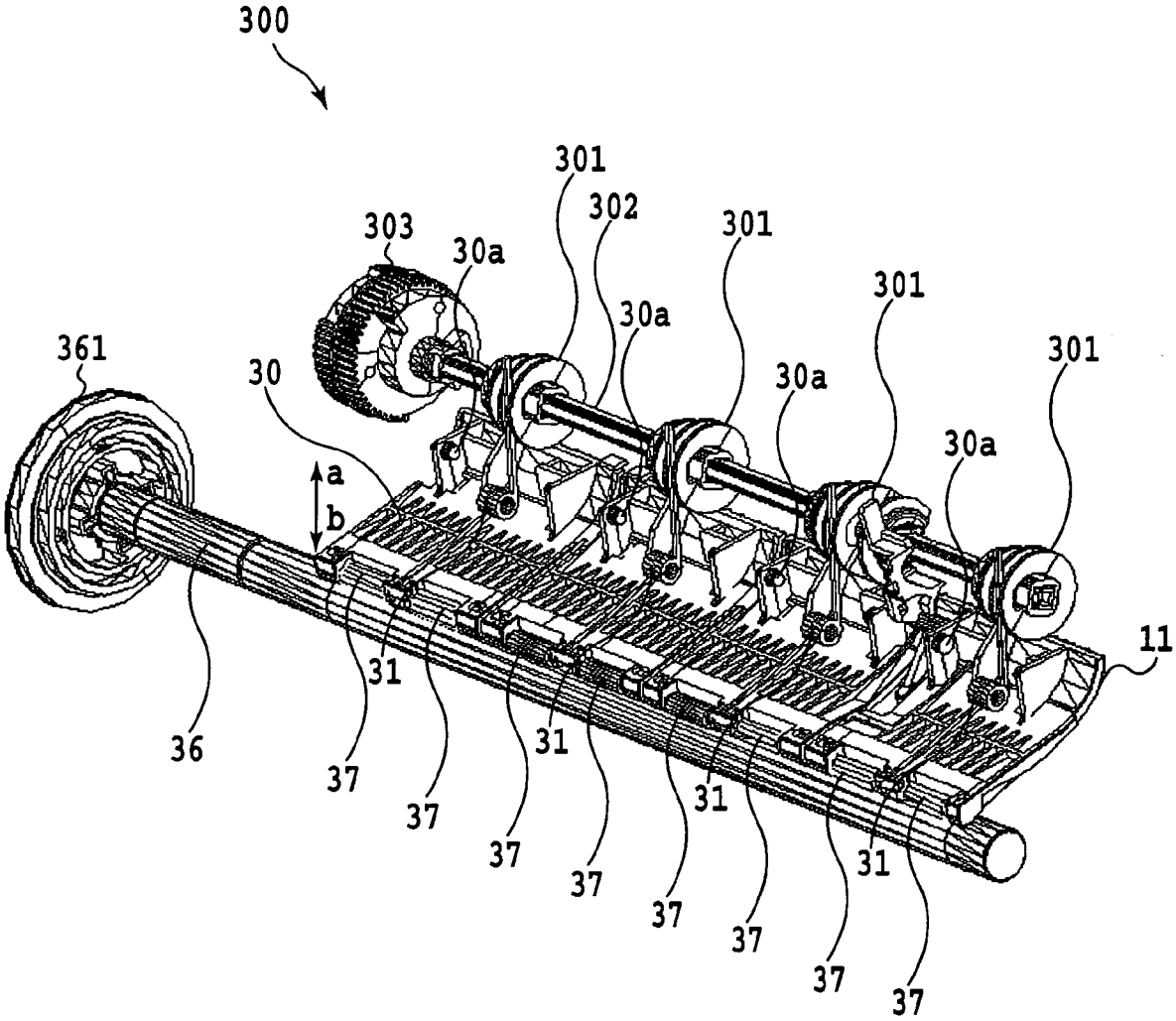
FIG. 4 is a perspective view showing a pinch roller raising and lowering mechanism according to the embodiment of the present invention.

FIG. 4 shows the configuration of an essential part of a pinch roller raising and lowering mechanism 300.

As previously described, the pinch roller 37 is supported by the leading end of the pinch roller holder 3. The trailing end of the pinch roller holder 30 is rotationally movably attached to the chassis 11 by the rotational movement fulcrum shaft 30*a*. The pinch roller holder 30 is urged by the pinch roller spring 31 into contact with the conveying roller 36. Further, a pinch roller release shaft 302 is attached to the chassis; the pinch roller release shaft 302 is formed by bending sheet metal into a U shape. A plurality of pinch roller release cams 301 are attached to the pinch roller release shaft 302 to press and release the trailing end of the pinch roller holder 30.

Moreover, a pinch roller release gear 303 is fixed to the end of the pinch roller release shaft 302 to transmit the driving force of the raise and lower driving motor 80 (not shown) to the pinch roller release shaft 302.

In the pinch roller raising and lowering mechanism 300 configured as described above, when the raise and lower driving motor 80 and thus the pinch roller release gear 303 are rotated, both the pinch roller release shaft 302 and the pinch roller release cam 301 rotate to cause the pinch roller release cam 301 to press the trailing end of the pinch roller holder 30. Thus, the pinch roller holder 30 rotates around the fulcrum shaft 30*a* in the direction shown by arrow a against the urging force of the pinch roller spring 31. The pinch roller 37 is separated from the conveying roller 36. When the raise and lower driving motor 80 further rotates to the predetermined position, the pinch roller release cam 301 releases the pinch roller holder 30. The pinch roller holder 30 is rotated in the direction of arrow b by the urging force of the pinch roller spring 31. The pinch roller 37 comes into pressure contact with the conveying roller 36 again.

Once the pinch roller raising and lowering mechanism 300 separates the pinch roller 37 from the conveying roller 36, the CPU 210 resumes the operation of printing the print medium. On this occasion, the print medium P is intermittently conveyed as in the case of the previous operations. However, the subsequent conveyance is carried out by the rotating force of the discharging rollers 40 and 41. The conveyed print medium P may be stopped on the conveying roller 36. However, at this time, the pinch roller 37 is at its raised position, so that the print medium is not pushed out by the nip between the pinch roller 37 and the conveying roller 36 as in the case of the prior art. The print medium is precisely conveyed at a present conveying pitch.

Accordingly, in the first embodiment, even after the pinch roller 37 is separated, 4-pass printing is carried out in the same manner as before the separation, as shown in FIG. 7. Therefore, when the trailing end of the print medium passes through the nip between the conveying roller and the pinch roller 37, control such as an increase in conveying distance or a shift in the range of nozzles in the print head 7 need not be performed as in the case of the prior art. Then, once the trailing end of the print medium passes beyond the nip position between the conveying roller 36 and the pinch roller 37, the CPU 210 rotates the raise and lower driving motor to clear the separation of the pinch roller 37. The pinch roller 37 is thus brought into pressure contact with the print medium P and conveying roller 36 again (see FIG. 5D). Subsequently, once the lowermost end of the trailing end of the print medium P is completely printed, a sheet discharging operation is started. The print medium P is discharged onto the sheet discharging tray 46.

In this manner, in the first embodiment, very simple control is performed, that is, the pinch roller 36 is simply raised when the trailing end of the print medium passes over the pinch roller 37. This control enables the print medium to be precisely conveyed at a present conveying pitch. Accordingly, in each scan of the print head, an image is printed on the print medium at an appropriate position. This makes it possible to prevent images formed during respective printing scans from becoming uneven. Further, even when marginless printing is carried out, the print medium is precisely conveyed to enable the trailing end of the print medium to be reliably printed. As a result, high quality images can be formed.

However, in the first embodiment, when the pinch roller raising and lowering mechanism 300 separates the pinch roller 37 from the print medium P, the trailing end of the print medium P may float slightly. This floating may cause the landing positions of ink droplets from the print head to deviate slightly in the sheet feeding direction and the carriage scanning direction. Thus, in the first embodiment, the amount by which the print medium is conveyed is corrected in view of landing errors associated with the floating of the print medium.

Figure 8A:
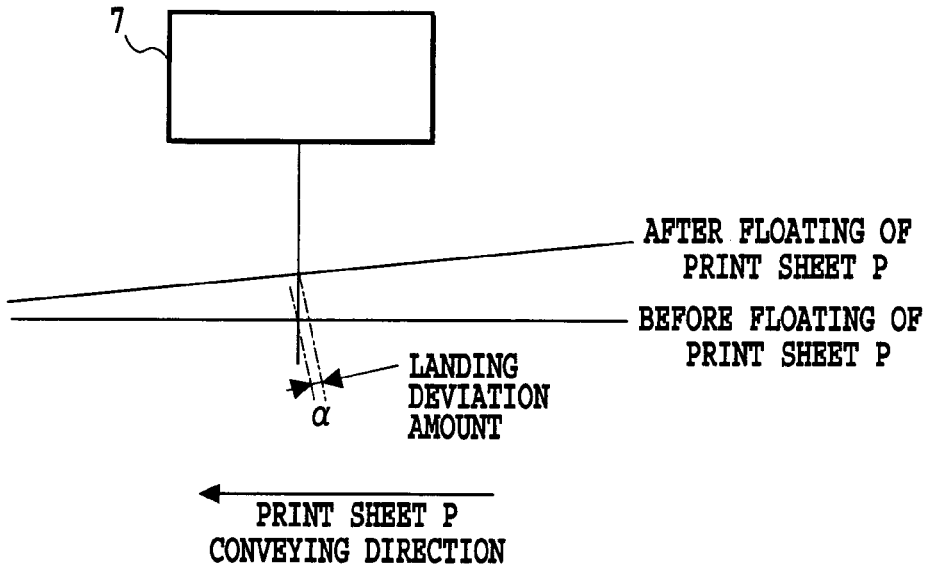
FIGS. 8A and 8B are diagrams showing that a print medium P has floated as a result of raising of a pinch roller 31 and that the floating has caused deviations in the impact of ink droplets.
Figure 8B:
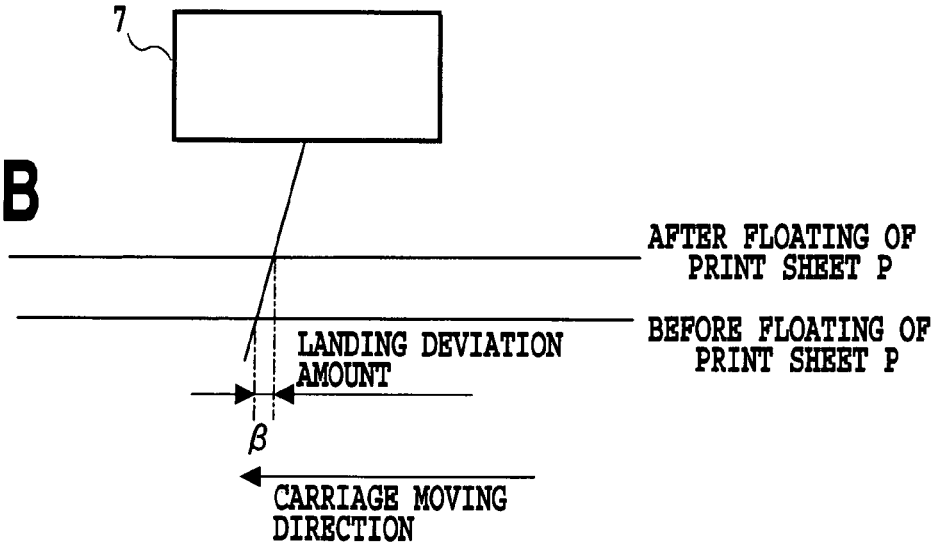

FIGS. 8A and 8B shows that the print medium P has floated as a result of raising of the pinch roller 31 and that the floating has caused deviations in the landing of ink droplets. In FIG. 8A, the floating print medium is viewed from the direction (carriage moving direction) orthogonal to the print medium conveying direction. In FIG. 8B, the floating print medium is viewed from the direction orthogonal to the carriage moving direction.

If the print medium P has floated, it is inclined with respect to the conveying direction. This results in a small deviation $\alpha$ in the landing position of the ink droplet. Further, as shown in FIG. 8B, in the carriage 50 scanning direction, the carriage 50 scan speed is applied to ink droplets ejected from the print head 7. Thus, when the distance between the print head 7 and the print medium changes, a deviation $\beta$ occurs in the landing position.

Thus, in the print medium conveying direction, the conveying amount is corrected by the deviation $\alpha$ for optimization. In this case, by controlling the conveying motor on the basis of the code wheel 362 and encoder sensor 363, coupled directly to the conveying roller, it is possible to correct the impact position on the sheet at 6,000 dpi increments (4.2 μm). For the deviation $\beta$ in the landing position in the carriage 50 scanning direction, by controlling the time at which ink is ejected from the print head 7 on the basis of the code strip 561 and the encoder sensor 56, mounted on the carriage 50, it is possible to correct the landing position on the sheet at 9, 600 dpi increments (2.6 μm). These correction values are preset and stored in the ROM 211 of the control section 201. By using the conveyance correction and the correction of the ink ejection timing, it is also possible to correct a variation in the distance between the print head and the print medium which variation is caused by the floating of the print medium P as a result of the separation of the pinch roller 37. Consequently, better images are ensured.

As described above, the first embodiment eliminates the need for special control such as the selection of an active area in the group of nozzles in the print head or a shift in the range of active nozzles. That is, high quality images can be obtained by performing simple control, for example, raising the driven roller (pinch roller 37) of the conveying means, delaying the time when ink is ejected from the print head, or reducing the conveying pitch for the print medium.

Further, when the trailing end of the print medium P nears the nip formed by the conveying roller 36 and the pinch roller 37, the distance over which the print medium is conveyed need not be increased as in the case of the prior art. This eliminates the need to improve the mechanical precision of the conveying means. The conveying means can be inexpensively constructed.

Second Embodiment

Figure 9:
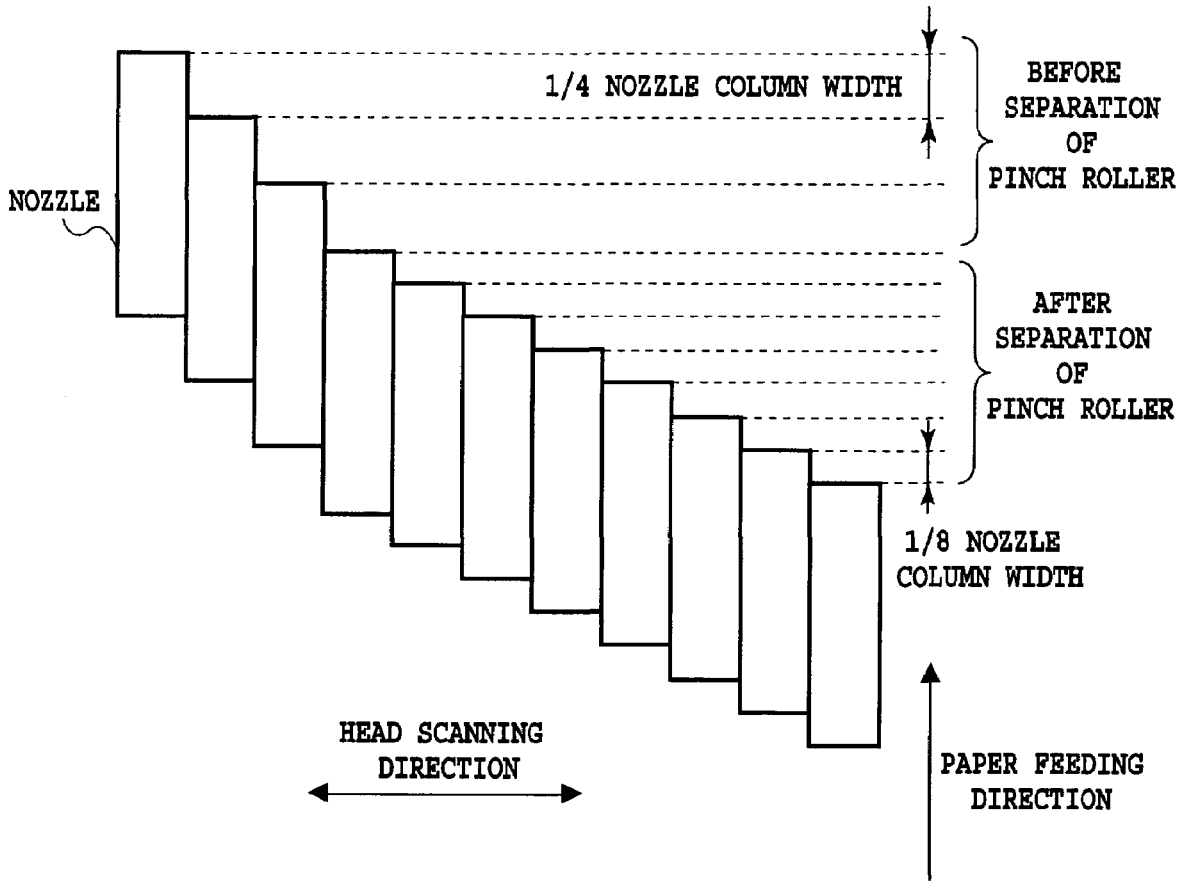
FIG. 9 is a diagram illustrating that the operation of conveying the print medium and the number of passes in the multi-pass printing are switched according to a second embodiment of the present invention.

In the above embodiment, while the print medium P is being conveyed, the multi-pass printing of four passes are carried out regardless of whether or not the pinch roller 37 is raised. However, as shown in FIG. 9, after the pinch roller 37 is raised, the conveying amount may be reduced to half so that 8-pass printing can be carried out.

The image quality improvement effect based on multi-pass printing is improved by doubling the number of passes of the multi-pass printing after the pinch roller 37 has been raised. This suppresses the deviation of the landing of ink droplets from the print head and a decrease in the accuracy with which print medium P is conveyed. Consequently, image quality can be further improved. In spite of a decrease in throughput, the printing accuracy is also improved by reducing the number of active nozzles to half to carry out 4-pass printing.

In the first and second embodiments, after the trailing end of the print medium P has passed through the nip portion between the conveying roller 36 and the pinch roller 37, the pinch roller 37 is returned, during a printing operation, to the position where it is in pressure contact with the conveying roller 36. However, the pinch roller 37 may be returned after the printing of the print medium P has been completed. In this case, in the above embodiments, the time required to return the pinch roller 37 is added to the time for printing, thus reducing the throughput. However, returning the pinch roller 37 after printing can be carried out using another operation period associated with another printing operation. In this case, the throughput can be improved. The other arrangements and operations are similar to those of the first embodiment.

Third Embodiment

In the above embodiment, the central position of the pinch roller 37 is slightly offset from the central position of the conveying roller 36 in the print medium conveying direction. However, instead, the offset may be eliminated as shown in FIGS. 10C and 10D.

Figure 10A:
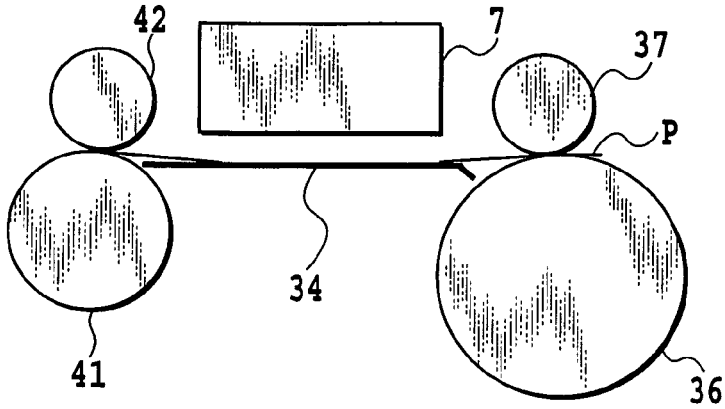
FIGS. 10A to 10D are diagrams illustrating a third embodiment of the present invention.
Figure 10B:
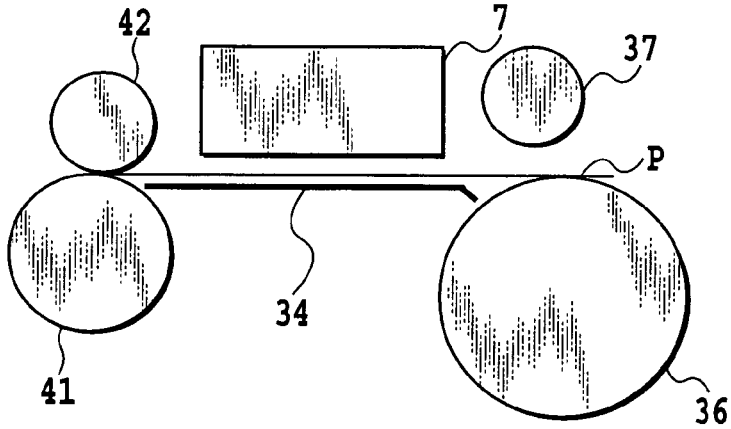

That is, FIG. 10A shows that when the pinch roller 37 is in contact with the conveying roller 36, the central position of the pinch roller is slightly offset from the central position of the conveying roller in the conveying direction, as described in the above embodiments. This state will be referred to as the state in which the pinch roller 37 is offset. Further, FIG. 10B shows that in the state shown in FIG. 10A, the pinch roller 37 is separated from the conveying roller 36.

As shown in FIG. 10A, when the pinch roller 37 lowers, the pressing force of the pinch roller 37 contacts the print medium with the platen 34. Further, as shown in FIG. 10B, when the pinch roller 37 rises, the print medium is flexibly bent to contact the top of the conveying roller 36. The print medium thus floats slightly upward from the platen 34.

Figure 10C:
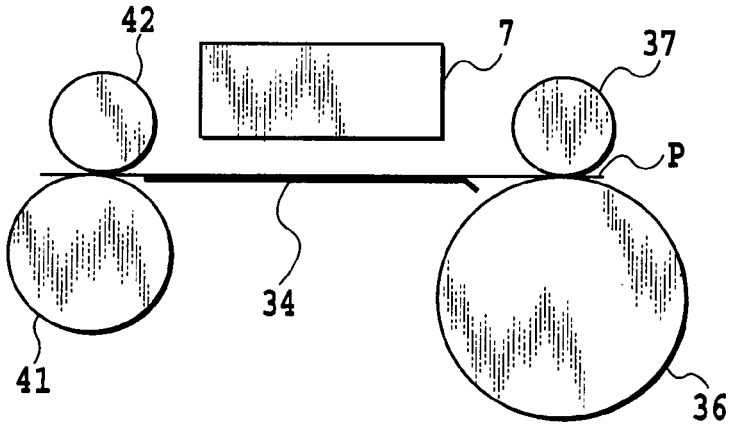
Figure 10D:
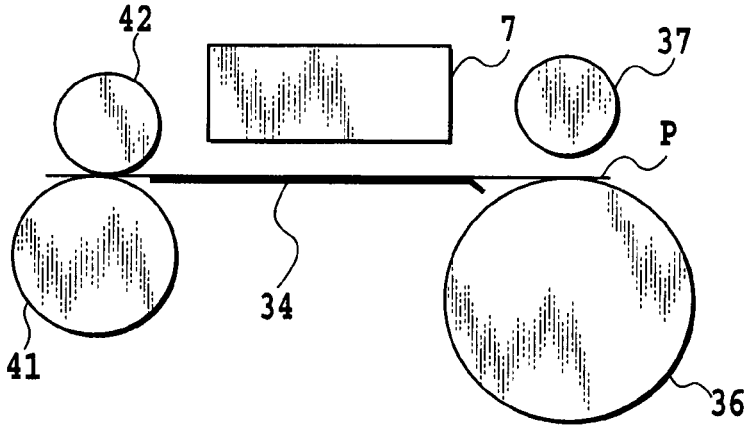

In contrast, in the third embodiment, the conveying roller 36 is flush with the top surface of the platen 34 and the central position of the pinch roller 37 can be aligned with the central position of the conveying roller 36 in the print medium conveying direction as shown in FIGS. 10C and 10D.

When the pinch roller 37 has lowered as shown in FIG. 10C, the print medium P is sandwiched between the uppermost position of the conveying roller 36 and the lowermost position of the pinch roller. The position where the print medium P is sandwiched coincides with the position of the top surface of the platen 34 in the height direction. Thus, even if the pinch roller 37 is raised after sandwiching, the print medium P is held between the uppermost position of the conveying roller and the top surface of the platen 4 in the same manner as before the rise. That is, the position of the print medium remains unchanged before and after the rise of the pinch roller 37, with the spacing between the print head and the print medium maintained at a fixed value. This prevents the landing position of ink droplets from deviating even when the pinch roller 37 is raised as in the case of the above embodiments. It is also unnecessary to execute processes such as the adjustment of ink ejection timings and the correction of the conveying amount. Thus, high quality images can be obtained by simpler control.

Fourth Embodiment

Figure 11A:
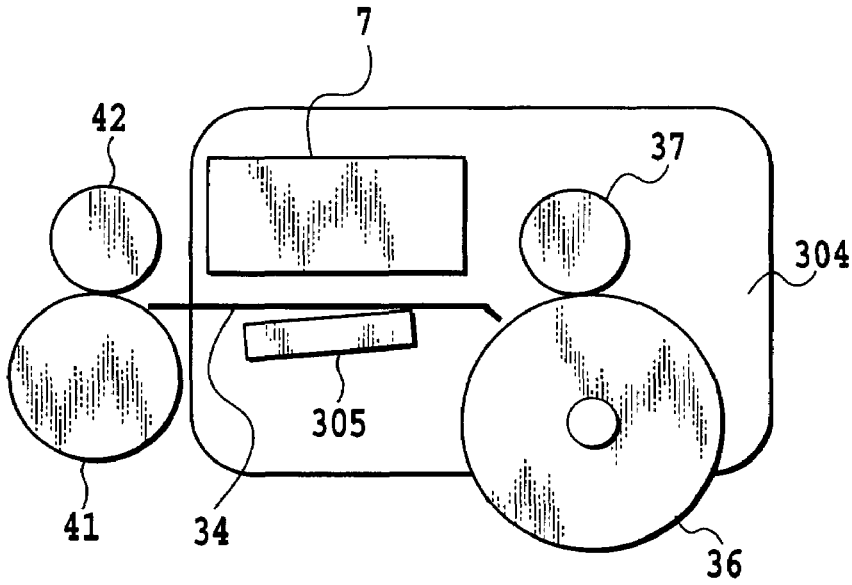
FIGS. 11A and 11B are diagrams illustrating a fourth embodiment of the present invention.

According to a fourth embodiment of the present invention, the following states are switched depending on whether or not the pinch roller 37 is raised: the state in which the central position of the pinch roller 37 is offset from the central position of the conveying roller 36 in the conveying direction as shown in FIG. 11A (this state will be referred to as the state in which the pinch roller 37 is offset) and the state in which the central position of the pinch roller 37 is not offset.

That is, the third embodiment has a pinch roller moving mechanism that switches the state in which the pinch roller 37 is offset and the state in which the pinch roller 37 is not offset, and a printing section raising and lowering mechanism that raises and lowers the carriage 50 and the print head 7.

The pinch roller moving mechanism rotationally moves a side plate 304 around the conveying roller 36. This in turn moves the pinch roller 37 along the outer periphery of the conveying roller 36 together with the pinch roller holder 30, held on the side plate 304. It is this possible to set the position where the pinch roller 37 is offset and the position where the pinch roller 37 is not offset.

Further, the printing section raising and lowering mechanism can raise and lower the platen 34 by rotating a platen stopper 305 provided on the side plate 304 so that the pinch roller moves as previously described. Furthermore, the carriage 50 and the print head 7 can be raised and lowered by rotating the main cam 63 (see FIG. 1) to raise or lower the guide shaft 52. Here, the carriage 50 and the print head 7 are raised or lowered using the main cam 63, depending on the movement of the pinch roller holder 30 (see FIG. 4), that is, the movement of the pinch roller 36 and platen 34. Furthermore, the amount by which the carriage 50 and the print head 7 move is set equal to that by which the platen 34 moves.

In the third embodiment configured as described above, if the print media used are easily deformed after printing like ordinary paper, the pinch roller 37 is set offset. This allows the print medium to contact the platen as previously described and also allows the printed print medium to be smoothly fed to the discharging roller, while being slightly flexed.

In contrast, if the print media are thick and so sturdy that they are less deformed after printing, when the pinch roller 37 is offset, the print media may be tilted or wrinkled. Moreover, the print media may not be readily fed to between the discharging roller and the spur. Thus, if the print media are thick and sturdy, the side plate 304 is rotated to move the pinch plate 37 to the position where it is not offset. Further, the platen stopper 305 is raised to move the platen 34 to substantially the same height as that of the pinch roller 37. At the same time, the main cam 63 is rotated to raise the carriage 50 and the print head 7 by the same amount as that by which the platen 34 has moved. This makes the nip formed by the conveying roller 36 and the pinch roller 37 flush with the top surface of the platen as well as the nip formed by the discharging roller 41 and the spur 42. This allows the print medium to be smoothly guided from the conveying roller 36 via the platen 34 to the discharging roller 40 without being flexed. Furthermore, when the trailing end of the print medium P reaches the neighborhood of the nip formed by the conveying roller 36 and the pinch roller 37, the pinch roller 37 is raised as in the case of the above embodiments. This prevents the conveying pitch of the print medium P from being inadvertently varied. It is also possible to maintain a fixed spacing between the print head and the print medium. Thus, high quality images can be formed even on thick and sturdy print media. Furthermore, the fixed spacing between the print head and the print medium avoids the contact between the print medium and the print head.

Figure 11B:
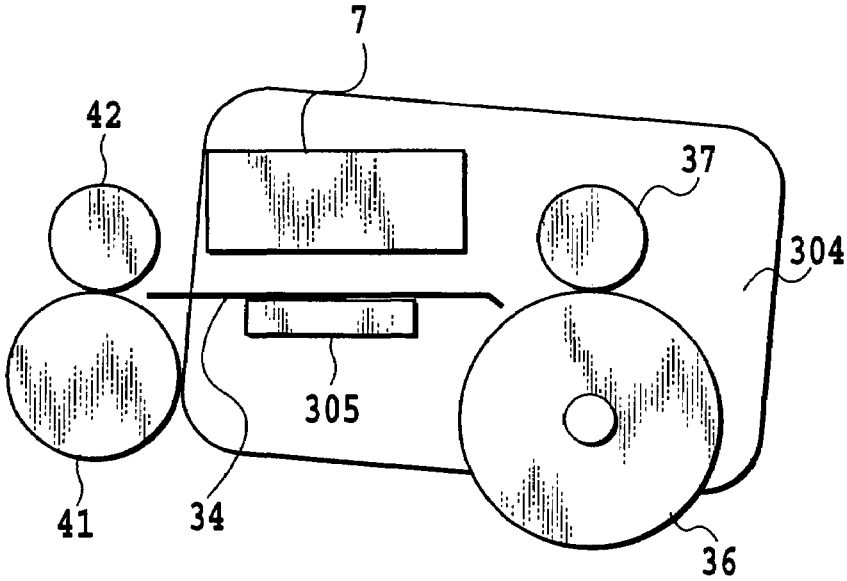

In the fourth embodiment, even if flexible print media such as ordinary paper are used, it is effective to use the above mechanism to raise the platen and the print head as shown in FIG. 11B at the same time when the pinch roller 37 is raised. This precludes the spacing between the print head and the print medium from varying as shown in FIG. 10A. The print medium P can be supported by the tops of the conveying roller 36 and discharging roller 41 and the top surface of the platen 34 as shown in FIG. 10D. Moreover, before and after the rise of the pinch roller 37, a printing operation can be performed while maintaining a fixed spacing between the print head and the print medium. Therefore, higher quality images can be obtained.

The present invention has been described in detail with respect to preferred embodiments, and it will now be apparent from the foregoing to those skilled in the art that changes and modifications may be made without departing from the invention in its broader aspects, and it is the intention, therefore, that the appended claims cover all such changes and modifications as fall within the true spirit of the invention.

This application claims priority from Japanese Patent Application No. 2004-238865 filed Aug. 18, 2004, which is hereby incorporated by reference herein.

What is claimed is:

1. An ink jet printing apparatus in which printing means ejects ink to a print medium for printing, the apparatus comprising:

a conveying roller disposed upstream of the printing means to convey the print medium;

a pinch roller that rotates in cooperation with the conveying roller;

a conveying motor that generates a driving force for driving the conveying roller;

a discharging roller that is driven by the conveying motor so as to convey the print medium downstream of the printing means;

moving means for moving the pinch roller from a position in which the print medium is sandwiched between the pinch roller and the conveying roller to a separated position with respect to the print medium before a trailing end of the print medium reaches a nip portion between the conveying roller and the pinch roller; and control means for varying a driving amount of the print medium between before and after separation of the pinch roller from the print medium, wherein the printing means has a group of nozzles comprising a plurality of nozzles arranged along a direction in which the print medium is conveyed, and the control means completes an image by causing a plurality of scans to be executed using different nozzles for the same print area of the print medium, and after the pinch roller is separated from the print medium, increases the number of scans required to complete the image in each of the print areas.

2. An ink jet printing apparatus in which printing means ejects ink to a print medium for printing, the apparatus comprising:

a conveying roller disposed upstream of the printing means to convey the print medium;

a pinch roller that rotates in cooperation with the conveying roller;

a conveying motor that generates a driving force for driving the conveying roller;

a discharging roller that is driven by the conveying motor so as to convey the print medium downstream of the printing means;

moving means for moving the pinch roller from a position in which the print medium is sandwiched between the pinch roller and the conveying roller to a separated position with respect to the print medium before a trailing end of the print medium reaches a nip portion between the conveying roller and the pinch roller; and control means for varying a driving amount of the print medium between before and after separation of the pinch roller from the print medium, wherein the control means varies an ink ejecting timing in a scanning direction of the printing means between before and after separation of the pinch roller from the print medium.

* * * * *